United States Patent [19]

Borodin

[11] Patent Number: 4,826,542

[45] Date of Patent: May 2, 1989

[54] METHOD FOR FORMING BAINITE

[75] Inventor: Daniel J. Borodin, Warren, Mich.

[73] Assignee: U.S. Automation Co., Detroit, Mich.

[21] Appl. No.: 80,605

[22] Filed: Aug. 3, 1987

[51] Int. Cl.[4] ..... C21D 8/00

[52] U.S. Cl. ..... 148/11.5 R; 148/12 R; 148/12 B; 148/12.1

[58] Field of Search ..... 148/12.4, 12 B, 12 R, 148/12.1, 138, 128, 13, 11.5 R

[56] References Cited

U.S. PATENT DOCUMENTS 3,964,938 6/1976 Tolliver et al. ..... 148/12 B

OTHER PUBLICATIONS

Making, Shaping & Treating of Steel, 9th ed., ©1971, pp. 607–609, 1086, 1089, 1091, 1100–1103.

*Primary Examiner*—Christopher W. Brody

*Attorney, Agent, or Firm*—Charles W. Chandle

[57] ABSTRACT

A method and apparatus for determining the critical temperature at which Bainite is formed from a low carbon steel, and for forming a steel material with a predetermined percentage of Bainite. The temperature of low carbon steel is raised to a temperature above the critical temperature at which Bainite is formed. The temperature is then raised to the critical temperature and maintained at that level until a predetermined percent of the steel microstructure has changed to Bainite.

A novel chain pump is disclosed for maintaining the steel at a selected temperature plateau.

21 Claims, 2 Drawing Sheets

METHOD FOR FORMING BAINITE

BACKGROUND OF THE INVENTION

This invention is related to a process and apparatus for processing a metal, such as a low carbon steel, to obtain a predictable amount of a particular micro-structure such as Bainite, or to obtain a predictable tensile strength, or a predictable reduction in cross-section. The specimen is elongated as it is being heated above the critical temperature for creating Austenite. The temperature of the specimen is then lowered in a molten salt bath to a temperature plateau corresponding to the Bainite critical temperature, for a predetermined period of time so that the percentage of Bainite, the ultimate tensile strength of the steel and other factors can be predicted from several specimens, and then repeated in a commercial process.

Thermastress process is a thermo-mechanical process developed over the past few years for producing steel and steel alloys with remarkable physical characteristics. The process differs from other conventionally used methods for making steel by deforming the steel material simultaneously with a rapid cooling step. Whereas high strength steels produced by processes based on U.S. Pat. No. 3,378,360, which issued to William H. McFarland on Apr. 16, 1968, are limited to relatively thin sections, in order to achieve the high rate of temperature drop to attain essentially a Martensitic microstructure, my Thermastress process is capable of producing sections greater than 0.375 inches. This is because the transformation of austenitized steel is accomplished by an apparent shift of the critical temperature for producing Bainite ($B_s$) brought about by the simultaneous application of stress and plastic deformation imposed on the steel. Further, the process inherently tends to produce Bainite rather than Martensite.

My early process was disclosed in U.S. Pat. No. 3,964,938 which issued June 22, 1976 for a "Method And Apparatus for Forming High Tensile Steel from Low and Medium Carbon Steel".

The basic Thermastress process involves moving material between two spaced driving means immediately adjacent heating and quenching zones. The effect of the two zones is to impose a temperature gradient on the material between the two drives so that after a gradual temperature rise, for example, to around 2,000° F., a rapid temperature drop is imposed on the processed material.

The relative speeds of the upstream drive and the downstream drive are so controlled that the ratio of the two drives can be changed without affecting the value of the material input speed.

If the ratio between the downstream drive with respect to the upstream drive exceeds unity, the processed material is stretched as it passes through the heating zone, where the yield strength of the material is substantially lowered. A condition of dynamic equilibrium occurs between the two drives as the material accelerates toward the downstream drive, establishing a very stable cross-section reduction profile with the cross-section of the processed material being reduced in inverse proportion to the increase in velocity. The final cross-section of the material obtained by elongation remains constant within very close dimensional tolerances.

In the case of low and medium carbon steel, the effect of a simultaneous rapid temperature drop as the material passes from the heating zone into the quenching zone, in conjunction with the plastic flow taking place, is to substantially modify the steel micro-structure. The fine grained micro-structure, thus produced, brings about an increase in the ultimate tensile strength as high as 220,000 p.s.i. and above at diameters, exceeding by a factor greater than 10, the thickness of high strength steel produced by the rapid quenching of conventional heated-finished sheet steel. Steel produced by the Thermastress process possesses excellent welding properties due to its relatively low carbon content.

One phenomenom related to the commercial Thermastress process is that the critical temperature, at which the micro-structure of steel neucleates to Bainite, as its temperature is being reduced, shifts upwardly, compared to the conventional time temperature curves for the micro-structure of such steels.

Heretofore, the process for forming Bainite has been either to increase the temperature of the steel to a temperature above the critical temperature to form Austenite, and then to lower the specimen to the critical $B_s$ temperature, missing the TTT nose, and maintaining the temperature stable at the $B_s$ temperature, for a time sufficient for the micro-structure of the steel to change to Bainite, a period that can take hours.

In the Thermastress process, the period for the micro-structure change to occur is significantly reduced. It is also believed that the elongation process causes the critical temperature for the formation of Bainite ($B_s$) as well as to shift upwardly in a pattern believed to be unknown to those skilled in the art. Further, even though the cooling curve in the Thermastress process does not miss the TTT noze, a substantial amount of Bainite is formed. That is to say there are no time vs. temperature, published curves for the formation for Martensite or Bainite as formed by the Thermastress process.

One approach for determining such a curve for a particular steel is to raise the temperature of a number of specimens to form Austenite and then to reduce the temperature of each specimen to a plateau at the critical temperature for Bainite ($B_s$). A set of specimens made at different periods along the temperature plateau and in a range of plateaus, and analyzed for Bainite content, will make the concentration of Bainite predictable for different steels and enable establishing the shift in $B_s$ level as related to the degree of material elongation.

SUMMARY OF THE INVENTION

The broad purpose of the present invention is to provide a method and apparatus for making time-temperature curves for Bainite formed in the Thermastress process, for a group of steels with varying carbon content. The method is believed to be suitable for other binary alloys subject to Martensitic transformation including nonferrous materials, for changing their microstructure.

Another purpose of the invention is to obtain curves for the ultimate tensile strength, the yield point, the elongation and the cross-section for different specimens for either maximizing the percentage of Bainite in the material or for providing a material with a predictable level of Bainite.

In the preferred embodiment of the invention, the material is heated in the conventional manner to change its micro-structure to Austenite, and then its temperature is reduced to a point within a range related to the $B_s$ temperature. The material is introduced into a molten salt flood box which establishes an isothermic zone.

Temperature grading curves and reduction profile curves are determined for a particular specimen, and the percentage of Bainite determined by conducting x-ray diffraction studies and transmission electron microscopy on the specimens. Once the cooling curves and the plateau temperature have been determined for a given material, the information can be employed for commercial production.

The molten salt flood box provides means for controlling the cooling curve for the $B_s$ plateau according to the material being processed.

Employing a molten salt bath provides several advantages. First, the bath can be maintained at a higher temperature than a conventional quenching material, such as water, because the adjusted $B_s$ level is in the area of 950°-1300° F., far above the boiling temperature of water. Secondly, the bath can be employed as a suitable cooling means for removing heat resulting from the process. The heat being removed results from cooling the steel, and secondly, because the Bainite forming process gives off heat. In addition, the bath employed in the preferred process lends itself to a continuous process for the commercial production of Bainite.

The cooling process can also be provided by adjusting the location of the quenching means with respect to the workpiece, to control the cooling curve, in the absence of the molten salt bath.

Still further objects and advantages will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

The preferred embodiment of the invention is illustrated for treating a low carbon steel wire, however, it appears feasible to utilize the present invention on sheet strip and bar stock as well as various alloy steels, exotic alloys such as high nickel alloys, nonferrous metals such as aluminum, copper alloys, and aluminum bronze for increasing their ultimate tensile strength or for other purposes such as providing a product having a predictable cross-section and corresponding tensile strength.

Figure 1:
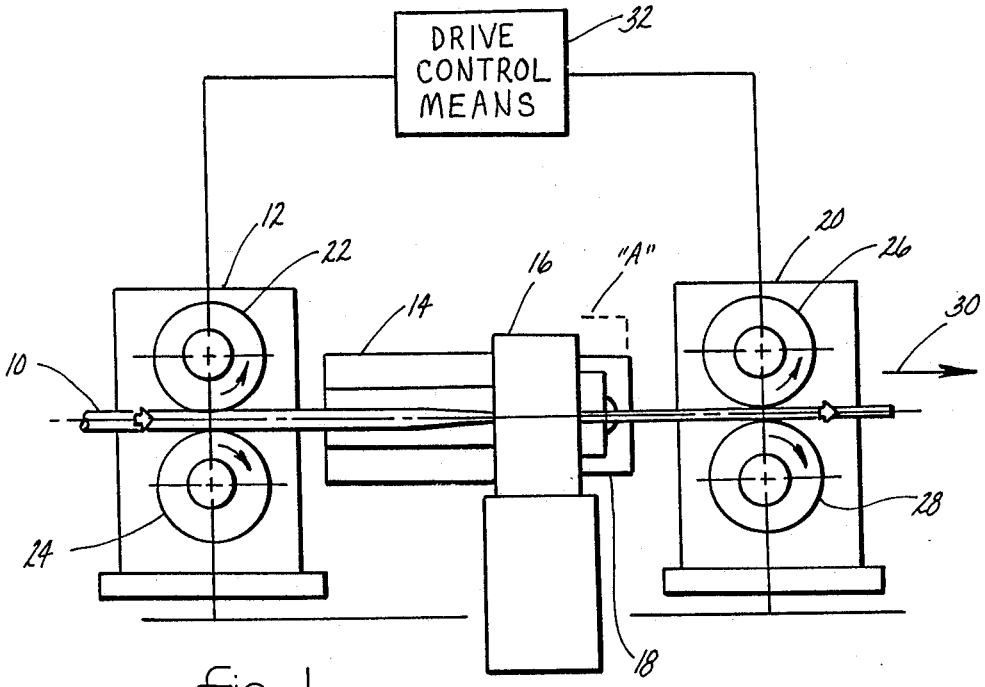
FIG. 1 is a schematic view of apparatus for carrying out the preferred method in which a steel alloy wire is processed through a pair of elongation drives, a high heat step, a controlled cooling step, and a quenching step.

Referring to FIG. 1, a wire rod 10, such as a SAE 1010 low carbon steel, is illustrated progressively passing through an upstream drive means 12, a heating means 14, a molten salt bath 16, a quenching means 18, and a downstream drive means 20. As rod 10 passes through the process, the rod cross-section is substantially reduced and the rod is elongated, for example, 100 percent elongation, to increase its ultimate tensile strength. The terms "upstream" and "downstream" are made with reference to the direction of travel of rod 10 as it passes through the apparatus.

Upstream drive means 12 may take any conventional form, such as is detailed in U.S. Pat. No. 3,964,938, and for illustrative purposes comprises a pair of roller means 22 and 24 which rotate in opposite directions and engage the rod to apply a driving force in the downstream direction. Similarly, downstream drive means 20 includes a pair of rollers 26 and 28 which also engage the wire rod to advance it in the downstream direction 30. Drive control means 32 are connected between the upstream and downstream drive means for controlling the rate of travel of the rod by controlling the force applied by the upstream and downstream drive means as the wire rod is being elongated.

The rollers of the downstream drive means are preferably operated at a greater rate of rotation than the upstream drive means to apply an elongating force on the rod as it passes through heating means 14. A very intense heat is applied to the rod as it is advanced through heating means 14. The rod's temperature increases to a level in excess of the Austenite conversion point of the rod, thereby causing the yield point of the rod material to drop below the level of the stress being applied to the wire by the differentially operating force applied by the upstream and downstream drive means.

Heating means 14 may take a source of fuel (not shown) such as oxygen and propane tanks adapted to direct flame through a nozzle (not shown) on the wire.

Figure 2:
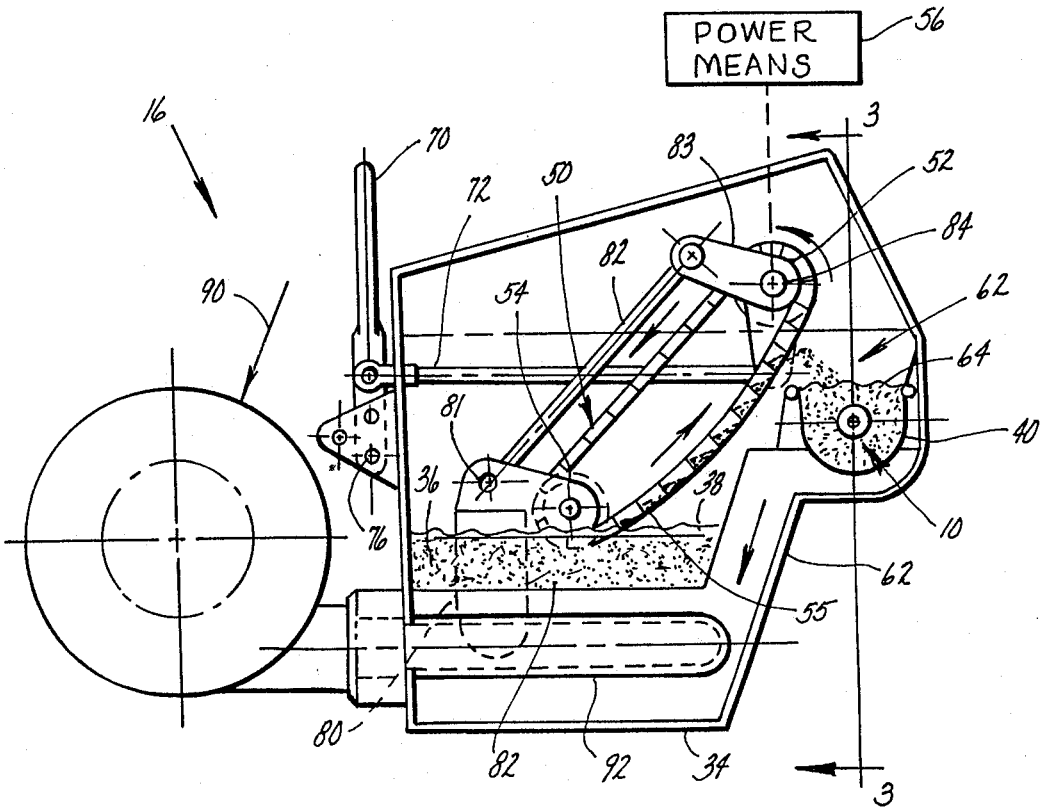
FIG. 2 is a sectional view through a preferred molten salt bath.
Figure 3:
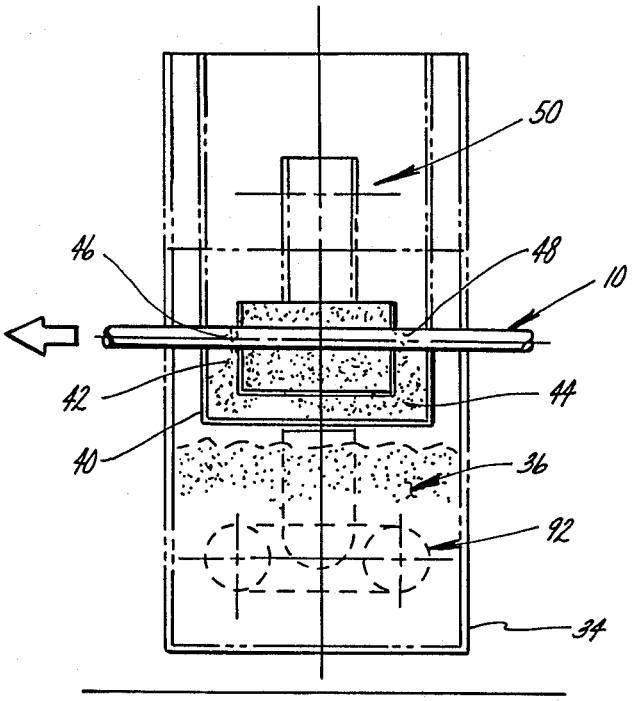
FIG. 3 is a view as seen along lines 3—3 of FIG. 2.

Molten salt bath 16 is located between heating means 14 and quenching means 18. Referring to FIGS. 2 and 3, molten salt bath 16 preferably comprises a casing 34 having a quantity of molten salt 36 at a level 38. The salt is maintained at a temperature accommodating the $B_s$ temperature of wire rod 10. A flood box 40 is supported in the casing above the level 38 of the molten salt. The flood box has a pair of end walls 42 and 44 with a pair of openings 46 and 48 for passing rod 10.

A chain belt 50 is mounted on drive sprocket means 52 and tail sprocket means 54 in casing 34. Chain belt 50 may be a Link Belt detachable chain of a high temperature steel, in which the downward extension on the links on the lower side of the chain pass up a trough 55 function as pump elements to raise the molten salt. Rotary power means 56 provide means for rotating the drive sprocket at a controlled rate to adjust the salt level in the flood box. The lower end of the chain belt passes below level 38 of the molten salt and then is raised upwardly, in the direction of the arrow 60, toward the flood box in such a manner that the molten salt falls off as illustrated at 62 into the flood box to form a level 64 totally immersing that part of the wire rod passing through the flood box. Thus the chain functions as a pump for raising the molten salt so it falls into the flood box.

The molten salt continuously passes out openings 46 and 48 of the flood box, down a return conduit 62 where it drops to the level 38 of the molten salt. Thus the salt is continuously being recycled into and out of the trough.

Handle 70 is connected by link 72 to lever 74 such that by pivoting the handle about pivot 76, lever 74 is swung in the counterclockwise direction, as viewed in FIG. 2, to raise chain 50 out of the molten salt to stop the pumping action.

Float 80 is pivotally mounted on shaft 81 and connected by rod 82 to a lever 83 pivotally carried on shaft 84 so as to form a four-bar linkage. Shaft 81, rod 82 and lever 83 swing such that the float biases the tail sprocket below the liquid level of the bath so that the moving chain passes into the bath to pick up molten salt.

A combination burner and blower means 90 is connected to a "U" shaped heat exchanger tube 92 disposed beneath level 38 of the salt bath to provide a temperature control means. The burner, which may be an appropriate gas burner, provides means for delivering hot gas through the tube when the temperature of the salt bath is initially being raised. When the molten salt has been raised to the appropriate temperature level and the process has begun, the hot wire rod entering the trough is at a temperature greater than the molten salt. The microstructure transformation is exothermic, creating further heat which must be removed to maintain proper temperature control of the rod. Consequently, the combination blower means then introduces cooling air through the "U" tube to remove heat from the salt bath caused by the hot rod, and the exothermic heat.

The processed rod is then moved downstream to the quenching means where it is cooled by an appropriate water supply (not shown) in a manner described in greater detail in my U.S. Pat. No. 3,964,938. The quenching means is movable to an adjusted position, such as at "A" in FIG. 1, so that the rod cooling rate can be adjusted even when the molten bath is not functioning. Control of the quenching means location with respect to the rod can be used to control the percent of Bainite formation, the rods tensile strength, and final cross-section.

Figure 4:
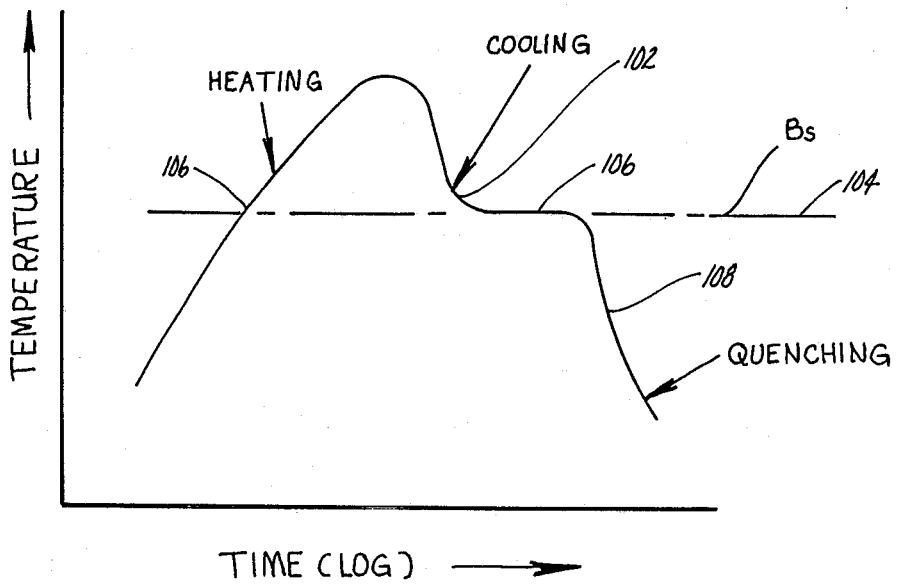
FIG. 4 is a chart showing the time-temperature curve for a typical specimen.

FIG. 4 is a chart illustrating the rod's temperature versus time pattern. As the rod passes through the heating means in zone 100, the temperature increases to a level above the austenitic forming temperature to austenitize it. The rod then is cooled as it enters the molten salt bath, zone 102 of the chart. The $B_s$ temperature 104, established for the particular material, is then maintained at a plateau 106 for a period of time sufficient to form the desired percentage of Bainite microstructure. The rod then enters the quenching stage 108 where its temperature is reduced to provide the final workpiece. The elongation is controlled by the upstream and downstream roller means to provide a selected, predictable cross-section or a desired elongation together with a predictable desired ultimate tensile strength by varying either the rotational rate of the upstream and downstream drive means, or the length of the plateau 106 of the cooling curve. Once the $B_s$ temperature has been determined, the preferred apparatus including, the salt bath can be employed, in a commercial application for the continuous production of rod having predictable, reproducible characteristics by controlling the heat of the salt bath by burner and blower means 90, and the period of time the material is immersed in the flood box.

The $B_s$ temperature of the material, which determines the plateau level, is determined for the particular alloy or material by heating and then cooling several specimens at various temperature levels, such as 20° increments, and then examining the microstructure of each specimen, to determine the microstructure change.

Having descried my invention, I claim:

1. A method for changing the micro-structure of a metallic material, comprising the steps of:

continuously moving the material along a path of motion adjacent a heating means and then a cooling means;

heating the material by the heating means as the material is in motion to an initial temperature such that the material changes to a first micro-structure;

then as the material continues in motion, reducing the temperature of the material by the cooling means according to a selected cooling pattern as the material continues in motion such that the material changes to a second micro-structure that depends on said selected cooling pattern; and elongating the material as it is in motion during both the heating step and the cooling step.

2. A method as defined in claim 1, in which the temperature is reduced according to a cooling rate that depends on said critical temperature level.

3. A method as defined in claim 1, in which the material is a steel alloy.

4. A method as defined in claim 1, in which the temperature is reduced according to a rate that is a function of the chemistry of the material.

5. A combination as defined in claim 1, in which the material is a steel material, and the critical temperature is the Bainitic nucleation temperature for the steel material.

6. A method as defined in claim 1, in which the temperature of the material is reduced so as to form a generally constant temperature plateau as the temperature passes down through said critical temperature.

7. A method as defined in claim 1, in which the material is a steel alloy, and the critical temperature is the temperature at which at least a portion of the material is nucleated into a Bainitic micro-structure.

8. A method as defined in claim 7, in which the material temperature is reduced to the temperature at which Bainitic micro-structure predominates and then the temperature of the material is maintained generally constant for a period sufficient to form a predetermined percentage of Bainite in the material.

9. A method as defined in claim 1, in which the material comprises a non-ferrous metal.

10. A method as defined in claim 1, in which the material comprises a nonferrous alloy.

11. A method as defined in claim 1, in which the material comprises steel wire.

12. A method as defined in claim 1, in which the material is a steel alloy and said heating step comprises heating said material to a temperature sufficient to austenitize it.

13. A method as defined in claim 1, in which said elongation step comprises elongating said material sufficient to change the critical temperature level.

14. A method as defined in claim 1, in which said material is moved and elongated between two spaced points by providing a first rotatable drive means located upstream from said heating and cooling means, and a second rotatable drive means located downstream from said heating and cooling means, said second rotatable drive means being rotated at a rate of rotation greater than the first rotatable drive means and at a ratio proportional to the desired reduction ratio of the material.

15. A method as defined in claim 1, in which a desired ultimate tensile strength for the material is selected, and the desired reduction ratio of the cross-section of the material is determined as a function of the change in the ultimate tensile strength of the material.

16. A method as defined in claim 1, in which the material comprises a steel material, and said method comprises:

moving the steel material between two spaced points;

said heating means being disposed between said spaced points;

applying an elongating force on the material between said two spaced points;

heating said steel material to a temperature such that its yield point drops below the level of the applied force whereby the steel material elongates and reduces the cross-section as the result of the application of said elongating force;

subsequently cooling said steel material.

17. A method for producing steel material having a particular predetermined ultimate tensile strength, comprising:

continuously moving the steel material relative to adjacent heating and cooling means;

heating the material at said heating means to a temperature rendering it plastic;

elongating and reducing said material in thickness between two spaced points located on opposite sides of said heating and cooling means;

thereafter cooling by said cooling means the material to a predetermined level corresponding to the critical temperature at which the steel material is converted to Bainite and controlling the ultimate tensile strength of the steel material by adjusting the length of time the steel material is being elongated at said critical temperature.

18. A method for producing steel material having a predetermined ultimate tensile strength, comprising:

continuously moving the steel material relative to adjacent heating and cooling means;

heating the material at said heating means to a temperature rendering it plastic;

elongating and reducing the cross-section of said material between said two spaced points;

thereafter cooling the material means to the critical temperature at which the steel material forms Bainite and then further dropping the temperature of the steel material after it has been converted to a predetermined percentage of Bainite.

19. A method for producing steel material having a particular predetermined desired ultimate tensile strength comprising:

continuously moving the steel material relative to adjacent heating and cooling means;

heating the material adjacent said heating means to a temperature rendering it plastic;

elongating and reducing the cross-section of said material between two points spaced on opposite sides of said heating and cooling means;

thereafter cooling the material to the temperature at which the steel material forms Bainite; and controlling the final ultimate tensile strength of the material by moving the material at a velocity that is a function of the final percentage of Bainite, in the steel material.

20. A method as defined in claim 1, in which the material is cooled in a molten salt bath, so as to maintain the material at said critical temperature for a predetermined period of time.

21. A method as defined in claim 1, in which the temperature of the material is reduced by quenching means, and the percentage of micro-structure change is adjusted by moving the the location of the quenching means an adjusted distance with respect to the path of motion of the material.

* * * * *